United States Patent [19]

Hoffman, Jr.

[11] Patent Number: 4,799,685

[45] Date of Patent: Jan. 24, 1989

[54] SAILBOAT RACING BOARD GAME

[76] Inventor: Galen W. Hoffman, Jr., 75 Cross St., Westerly, R.I. 02891

[21] Appl. No.: 25,645

[22] Filed: Mar. 13, 1987

[51] Int. Cl.[4] ..... A63F 3/00

[52] U.S. Cl. ..... 273/246

[58] Field of Search ..... 273/246, 298, 294, 251, 273/252, 253, 254

[56] References Cited

U.S. PATENT DOCUMENTS

| | | | |
|---|---|---|---|
| 375,419 | 12/1887 | Guillaume | 273/246 |
| 1,474,539 | 11/1923 | McKay | 273/248 |
| 1,500,782 | 7/1924 | Vegiard | 273/246 |
| 1,564,458 | 12/1925 | Whiting | 273/246 |
| 2,455,519 | 12/1948 | Powers, Jr. | 273/246 |
| 2,572,412 | 10/1951 | Wharton Jr. | 273/246 |
| 4,317,570 | 3/1982 | Brunton | 273/246 |
| 4,434,984 | 3/1984 | Bergstrom | 273/246 |

FOREIGN PATENT DOCUMENTS

| | | | |
|---|---|---|---|
| 889725 | 2/1962 | United Kingdom | 273/246 |

OTHER PUBLICATIONS

Sail Away, Racing Game Instructions.
Schiano, from the "Journal Bulletin".

*Primary Examiner*—Richard C. Pinkham
*Assistant Examiner*—Benjamin Layno
*Attorney, Agent, or Firm*—Bacon & Thomas

[57] ABSTRACT

A sailboat racing board game and game board therefor is provided for racing game pieces through a race course made from contiguous squares. An upwind leg of the race course provides tacking movement for the game pieces can move forwardly against a fixed wind direction. The squares along the upwind leg are oriented in a particular direction so that the game pieces can move in diagonal directions with respect to the fixed wind direction to simulate tacking. While at the same time, the game pieces are not moving in a direction which is diagonal with respect to the orientation of the squares. The game also provides game cards which the players pick up if they land on certain indicated squares on the game board.

15 Claims, 4 Drawing Sheets

FIG. 1
PRIOR ART
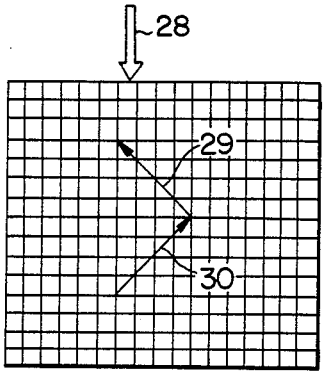
FIG. 2
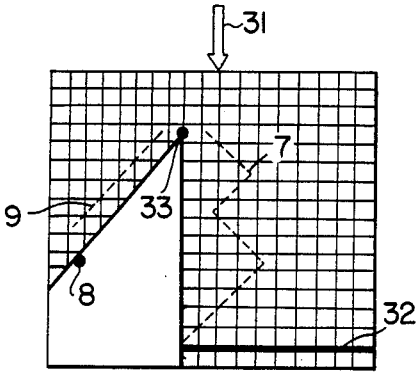
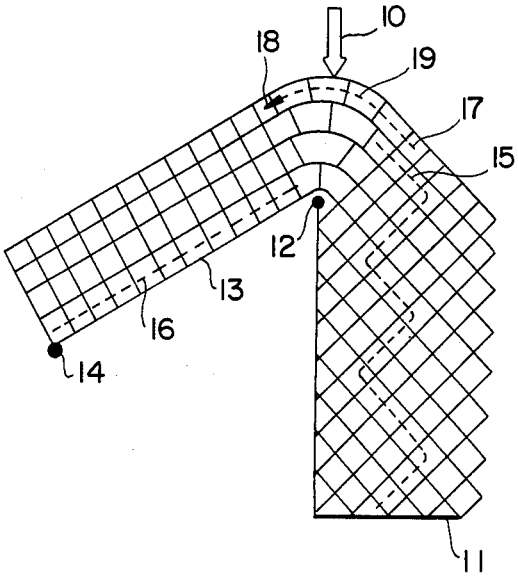
FIG. 3
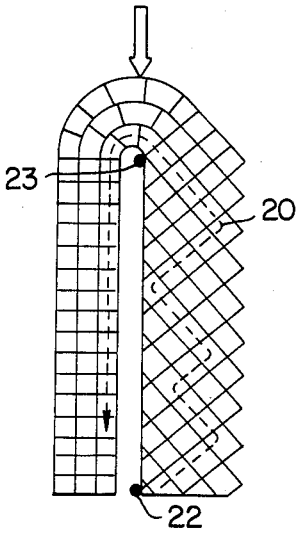
FIG. 4

EQUIPMENT FAILURE, MOVE BACK TWO SPACES
FIG. 7
WIND SHIFT, MOVE AHEAD THREE SPACES
FIG. 8
WIND SHIFT, MOVE BACK THREE SPACES
FIG. 9
MAN OVERBOARD MOVE BACK TWO SPACES AND OVER ONE
FIG. 10
CORRECT SAIL TRIM, MOVE AHEAD TWO SPACES
FIG. 11
BAD SAIL TRIM, MOVE BACK THREE SPACES
FIG. 12
GOOD TACK, MOVE AHEAD TWO SPACES
FIG. 13
BACK TACK, MOVE SIDEWAYS TWO SPACES
FIG. 14
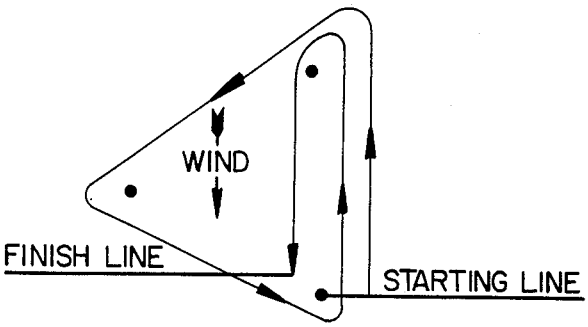
FIG. 15
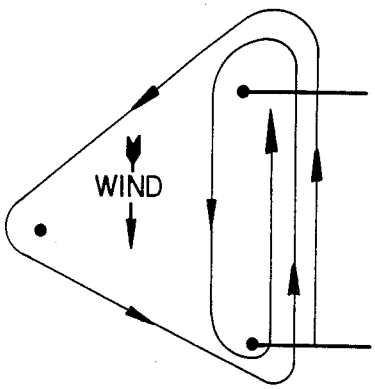
FIG. 16
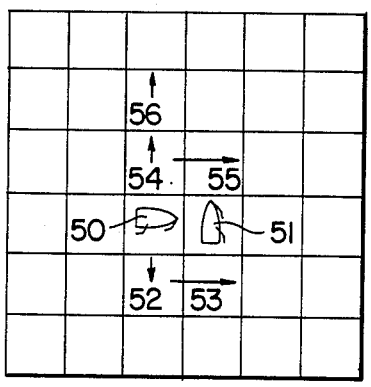
FIG. 17
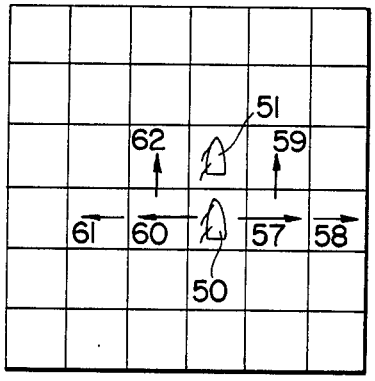
FIG. 18
FIG. 19
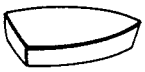

SAILBOAT RACING BOARD GAME

BACKGROUND OF THE INVENTION

1. Field of the Invention

The present invention relates to board games of the type which simulate a sailboat race. Typically, board games of this type are played by moving game pieces on the surface of a playing board in response to a chance event such as a roll of a pair of dice. The game pieces are moved to simulate a race on a course which is illustrated on the game board as a simulated body of water.

2. Description of the Related Art

Various types of board games are available which allow the players to engage in a simulated sailboat race which takes place on the surface of a playing board. Sailboat racing board games should provide a means for indicating the various events which may actually occur in a real life sailboat race. For example, the game, if it is to simulate the genuine experience of racing a sailboat, should provide a means for indicating the configuration of the course and the direction of the wind. In addition, there should be provided a suitable game board surface which allows the players to select various courses in relationship to the wind direction and to be able to select these courses as part of an overall strategy to win the race. The game should also provide the players with the same types of problems encountered in a real sailboat race so that the players can experience the thrill of racing to victory in the face of the types of problems encountered in a real race.

Sailboat racing games should also provide the players with the same types of occurrences experienced in a real race. The game should also provide the players with some sort of decision making opportunities so that the players can develop a strategy to win the race. Preferably, the decision making should involve taking certain risks which can either help or hinder their efforts, depending upon the outcome of the risk factor. Ideally, the players should have some control over the taking of these risks and, thus, they should have the option of taking a more conservative, less risky course or taking a course involving more risk which could enhance their speed and allow them to win the race. Also, to some extent, random occurrences should play some role in the outcome of the race, regardless of the strategy employed by the players since in real races unfortunate or fortunate events can occur despite the best sailing tactics, equipment or crew. The sailboat game should incorporate these types of factors in an uncomplicated manner so that players of many different age groups can easily play the game.

One such type of sailboat race game is described in U.S. Pat. No. 2,455,519. The sailboat race game described in this patent utilizes a game board which is marked off into squares. Players advance their game pieces, which are in the shape of sailboats, from one square to the next a given number of squares in accordance with a number generated by a chance event such as the roll of a pair of dice. The game board has a wind direction indicator, a starting line and a finishing line. In addition, the board has markings thereon which indicate the course the boats must take to complete the race.

In spite of all the provisions utilized in U.S. Pat. No. 2,455,519, the game fails to provide certain aspects which could make the game more realistic while also being easy to use. For example, the game board uses a grid work which forms a set of squares, all of which are oriented in the same direction. As a result of this orientation, a player when "sailing" his game piece in a typical triangular sailboat race course, particularly a course in the shape of an equilateral triangle, will be forced to move from square to square in a diagonal direction during at least one leg of the race if he wishes to reach his destination as quickly as possible. For example, if the wind is out of the north and the squares are formed by the intersection of north/south and east/west lines, then when a player needs to sail in a northerly direction he is forced to tack in alternate north-east and north-west directions since a sailboat cannot sail directly into the wind. As a result, the players must advance their pieces diagonally from one square to the next through the corners of each square during the tacking maneuver. Such a movement is difficult to accomplish visually because the eye is easily distracted when trying to advance through the squares diagonally. Consequently, players may easily miscount the squares or not move their pieces in a straight line.

Another deficiency with respect to all the squares being oriented in the same direction relates to the loss of realism when a boat tacks diagonally through the corners of each square. In a real sailboat, tacking is used to move the boat in an upward direction. Usually, a boat with the sails properly set, can sail or point into the wind at about a 45° angle. However, the amount of time it takes to move the boat a given distance directly upwind is greater than the time it would take to sail the boat the same distance if the wind were blowing in a move favorable direction such is at a 90° angle relative to the direction of the boat. The game should simulate this condition by assuring that tacking requires the boat to pass through a greater number of squares to go from a first square to a second square which lies directly upwind in relationship to the first square, than it would take to go directly in a straight line from the first square to the second square. This does not occur when tacking requires a player to pass diagonally from square to square through the corners of each square.

The use of squares in a sailboat game board is also disclosed in U.S. Pat. Nos. 1,474,539 and 2,572,412. These patents use a similar set of squares, all of which are oriented in the same direction and, thus, suffer from the same disadvantages found in U.S. Pat. No. 2,455,519.

U.S. Pat. No. 1,500,782 discloses a game board for a sailboat race wherein the course is generally triangular in shape and marked off by buoys. This game board does not provide an array of squares but instead relies on a rigid set of lines and circles to define a course. As a result, the players are not given much opportunity to experience the decision making aspects of a real sailboat race.

U.S. Pat. No. 375,419 discloses a sailboat board game which has a narrow race course. The narrow race course requires the players to keep their game pieces on a track and it does not allow the players to choose their own course. Consequently, this arrangement deprives the players of an essential feeling of realism required by games of this type.

U.S. Pat. No. 4,434,984 utilizes a game board having a complex array of unconnected squares, circles and hexagons. This game is difficult to use since it does not use a simple pattern of squares which would make playing far easier.

None of the prior art sailboat games provides a simple arrangement of squares and the like which allows the players to experience a wide variety of simulated sailboat racing conditions, nor do these prior art games allow a player to exercise numerous strategic decisions in a simplified manner. Accordingly, a need exists in the art to provide an improved simulated sailboat racing game which incorporates the desired features described above.

SUMMARY OF THE INVENTION

It is an object of the present invention to provide an easy-to-play sailboat racing board game which employs a grid work of squares or similarly shaped four-sided figures on a game board which does not have the disadvantages of the prior sailboat racing games which also employ a grid work of squares.

It is a further object of this invention to provide a sailboat racing board game which gives the players a sense of realism by allowing the players to experience many of the decisions, problems and risks involved in real sailboat racing.

These and other objects of the invention are provided by a particular type of sailboat board game apparatus. The apparatus utilizes a game board having a race course, especially a triangular race course, on a simulated body of water. The simulated body of water upon which the race takes place is marked off with intersecting lines into squares and the race course is indicated on the board by a plurality of markers which represent buoys. Preferably, three markers are used to form a triangular race course.

Games pieces are provided to represent the sailboats which the players advance around the race course by advancing from square to square. The number of squares advanced by each player is determined by a chance event such as the roll of a pair of dice, which may also be provided. A fixed wind direction is indicated on the game board by suitable indicia such as an arrow. A set of game cards is also provided, each of which indicate fortunate or unfortunate events which either respectively reward or penalize the player in possession of the card. Certain squares on the board are marked to instruct a player to pick up one of the game cards when their game piece lands on the marked square.

The squares formed by the intersecting lines need not be precise squares in the geometric sense. The only requirement is that they be formed by a set of generally parallel lines intersecting at about 90° with another set of generally parallel lines to form columns and rows of squares. Thus, the squares may be generally rectangular in shape, although absolute geometric precision is not a prerequisite.

As in real sailboat racing, in the simulated version provided by this game, the players may begin at a starting line and proceed from one buoy or marker to the next and go around the buoys in a predetermined sequence until they reach a finish line. The distance between one buoy or marker and the next defines a segment or leg of the race course. The start and finish line may be indicated on the game board by appropriate indicia such as a line or numbers on certain squares where the race begins and ends.

An important feature of the invention resides in the orientation of the squares along each leg of the race course in relationship to the wind direction and direction the boat is travelling. In particular, the squares are oriented along each leg of the race course by arranging the intersecting lines which form the squares so that when a player advances his game piece he can do so by moving along a line of direction which crosses a pair of opposing sides of each square through which the game piece passes and which does not pass diagonally through the corners of the squares and which approximates the permissible sailing directions experienced under real sailing conditions in relationship to the wind direction. In other words, in any particular leg of the race course, the game piece may be advanced in a direction which crosses one set of parallel lines but does not cross the second set which is at about 90° to the first set while observing the permissible sailing directions with respect to the wind.

As a result of this orientation, the players can observe the realism of sailing, especially the impossibility of sailing directly into the wind, without having to advance their game pieces through the corners of the squares in a diagonal direction. This is illustrated by considering a leg of the race wherein the players are required to sail upward from a south buoy to a north buoy lying due north of the south buoy and the wind is blowing directly out of the north. In a real race, the boats cannot sail directly into the wind and, generally, many sailboats cannot point into the wind less than about 45° and still maintain an acceptable forward speed. Thus, real sailboats must tack in alternate north-east and north-west directions to move in a northerly direction with the wind blowing out of the north. In order to simulate this factor, the squares are oriented so that the direction of the game piece movement when moving in a direction which approximates the permissible angle of said with respect to the wind, the players can advance their game pieces along an imaginary line which intersects a pair of opposing lines on the squares through which they travel, and which does not pass over the corners of those squares. Likewise, the squares in the other legs of the race will be oriented so that the boats can complete the race without having to pass from one square to the next by passing through the corners of the squares. Thus, when the wind is from the north, and a triangular race course is used, the squares in the upwind leg may be oriented in a north-east/-north-west direction by being formed by the intersection of north-east and north-west lines. Another leg may be oriented in a slightly different direction so that the players can move their game pieces in a straight line from one buoy to the next by traversing the opposing edges of the squares without passing over the corners of any of the squares. This might occur, for example, along a leg wherein the boat is travelling with the wind coming from astern of the starboard beam (broad starboard reach) or along a leg wherein the wind is coming from astern of the port beam (broad port reach). Similarly, if the race course requires that the boats travel directly south from the north buoy to the south buoy with the direction of the wind (running or running before the wind) then those squares may be oriented in a north-/south direction so that the boat can travel from one buoy to the next in the shortest possible distance while passing through the opposing edges of the squares through which the boat moves and without crossing the corners of any of the squares.

When the orientation of the squares differs from one leg to another, the continuity of the squares is preserved by distorting the squares in the area where the orientation of the squares changes from one leg to the other.

By preserving the continuity of the squares by distorting the squares where one leg meets another, the squares in one leg remain contiguous with the squares of the other legs.

It will be observed that the distorted squares will not be square in the strict geometric sense since they are distorted. However, they are considered squares within the context of game boards even though the distorted squares have curved sides or not all of their internal angles are 90°.

The orientation of the squares avoids the necessity of moving the game pieces diagonally from square to square through the corners of the squares and instead permits the players to move along a column or row of squares. Such a movement is much easier to accomplish without misdirecting the game pieces onto a wrong square. Also, the orientation allows the players to experience the realism of slower forward speed when tacking by forcing the players to pass through additional squares than they would have to if they were tacking diagonally across the corners of the squares.

The legs of the race course in accordance with this invention simulate the legs used in real sailboat racing. Thus, a race course in accordance with this invention may have any combination of legs selected from the following: upwind leg, downwind or running leg, port beam reach leg, starboard beam reach leg, port broad reach leg and starboard broad reach leg.

An upwind leg is any leg which requires a sailboat to "beat" into the wind. A sailboat is "beating" when his angle of sail is such that the wind is coming forward of the beam. This may also be described as being close hauled. Most upwind legs are directly upwind and require tacking to proceed from one buoy to the next.

In a beam reach leg, the wind is coming off the beam, i.e., about 90° with respect to the boat. If the wind is coming from the port side it is called a port beam reach. Likewise, in a starboard beam reach the wind is coming from the starboard side.

In a broad reach leg the wind is coming astern of the beam but not directly from behind the boat. As in beam reaches, there are port and starboard broad reaches.

A downwind or running leg is a leg wherein the wind is coming from a direction which is approximately behind the boat.

The squares in the upwind legs are formed by one set of generally parallel lines which are approximately parallel to the closest angle of sail a sailboat can sail into the wind and another set of generally parallel lines oriented at about 90° with respect to the first set of lines. In the other legs, the squares are oriented by being formed by the intersection of one set of generally parallel lines which is approximately parallel to the leg, with another set of parallel lines which is generally perpendicular to the leg.

Another important feature of the game board resides in the placement of markings on some of the squares which indicate that a player must pick up a game card when landing on the marked square. The marked squares are located in a plurality of locations so that a player can land on those squares by choosing a course which maximizes his chance of landing on them or, alternatively, choosing a course of direction which minimizes the probability of landing on those squares. Thus, the marked squares on a game board of squares allow a player to choose a conservative course of little risk which avoids the squares or a risky course which could have helpful or detrimental results, depending on the card a player receives when landing on the marked squares.

The cards indicate various problems and events encountered in real racing. Some events are beneficial and the game simulates the benefit by directing the player to advance his game piece a particular number of spaces which is commensurate with the benefit. Likewise, problems and detrimental events are indicated by directing the player to move the game pieces backward and/or sideways.

The marked squares and the game cards can be used with any sailboat racing game wherein the simulated body of water is marked off into squares. Preferably, it is used in combination with a game board wherein the squares of the legs are oriented in accordance with this invention.

BRIEF DESCRIPTION OF THE DRAWINGS

FIG. 1 is an illustration of a prior art game board which comprises squares.

FIG. 2 is an illustration of a game which shows two legs of a sailboard race course wherein the squares are all oriented in the same direction.

FIG. 3 is an illustration of a game board which shows the two legs of FIG. 2 wherein the squares of each leg are oriented in a different direction in accordance with this invention.

FIG. 4 is an illustration of a game board in accordance with this invention which shows the orientation of the squares in upwind and downwind legs of a race course.

FIGS. 7–14 illustrate the various types of game cards used in a preferred embodiment of the invention.

FIG. 15 illustrates an olympic race course as it would be played on the game board of FIG. 5.

FIG. 16 illustrates an American Cup race course as it would be played on the game board of FIG. 5.

FIGS. 17 and 18 illustrate possible directions a boat may move when on a collision course with another boat in accordance with this invention.

FIG. 19 is a perspective view of a game piece in the shape of a sailboat.

DETAILED DESCRIPTION OF THE INVENTION AND PREFERRED EMBODIMENTS

Figure 5:
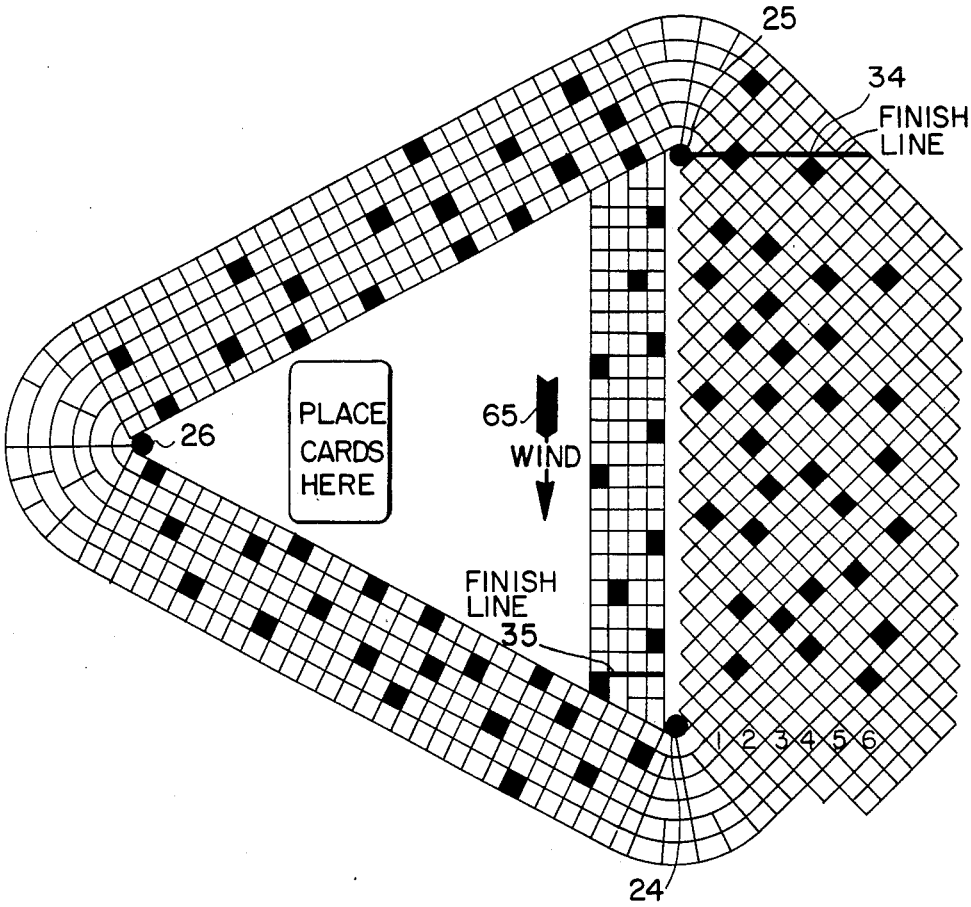
FIG. 5 is an illustration of a game board in accordance with a preferred embodiment of this invention.

The orientations of the squares in accordance with the present invention is best illustrated by reference to the drawings. FIG. 1 illustrates a prior art sailboat game board wherein all the squares are oriented in the same direction. When the wind is blowing in the direction indicated by arrow 28, a player, when sailing against the wind, must sail along the route indicated by arrows 29 and 30. Such a route requires the player to advance his game piece diagonally through the corners of the squares as illustrated.

FIG. 2 illustrates the type of problem which can occur if a game board provides two legs of a race course and all the squares are oriented in the same direction. In FIG. 2 the wind direction is shown by arrow 31. The first leg begins at the starting line 32 and ends at buoy marker 33. As a result, the players must tack back and forth as shown by dashed line 7 which force the players to move diagonally through the corners of the squares.

After the players move their game pieces around buoy marker 33 and begin the second leg of the race, the most advantageous route, i.e., a straight line broad reach between buoys 33 and 8, requires the players to move their game pieces along line 9 which is also along a diagonal passing through the corners of the squares.

FIG. 3 shows how the squares on a sailboat racing game board can be oriented in different directions along each leg so that the players can move their game pieces along the columns or rows of squares and thus avoid the necessity of moving diagonally across the squares while allowing the game pieces to move diagonally with respect to the wind direction. In FIG. 3, the wind direction is indicated by arrow 10. An upwind leg begins at starting line 11 and ends at marker buoy 12. The squares are oriented along the first leg by the intersecting of lines drawn in a direction which approximates the closest angle that a boat may sail into the wind, i.e., about 45° with respect to the wind direction. Game pieces can, therefore, tack diagonally across the wind without having to move in a diagonal direction with respect to the orientation of the squares. Dashed zig-zag line 15 shows this directional movement.

The second leg of the race course shown in FIG. 3 lies along a line 13 which is about 60° from the wind direction. Line 13 extends from buoy 12 to buoy 14. Legs set apart by 60° angles would be found, for example, in an equilateral triangular race course, a preferred race course of this invention. The squares along the second leg of the race are oriented so that a player can advance his game piece in a straight line from buoy 12 to buoy 14 while remaining within the confines of a selected column of squares. Such a direction is indicated by dashed line 16.

The continuity of the squares in the two legs shown in FIG. 3 is preserved by bridging these squares of the first leg with the squares of the second leg with distorted squares which bend around the buoy 12. The distorted squares are shown with curved sides and they connect the corresponding squares of the two legs so that the squares are contiguous. Thus, a game piece in square 17 in the first leg can progress to the corresponding square 18 in the second leg by passing through the distorted squares as indicated by arrow 19.

FIG. 4 illustrates a similar situation wherein the squares are oriented in each leg so that a boat sailing in an upwind direction can tack back and forth as in the first leg of FIG. 3 and then can sail directly downwind along a line parallel to the first leg without having to go diagonally through the squares. Such a path is indicated by arrow 20. Also shown in FIG. 4 is a wind direction arrow 21 and buoy markers 22 and 23.

A preferred embodiment of the game board is shown in FIG. 5. FIG. 5 shows a game board which simulates a race course which can be utilized in a simulated America's Cup type of race or a simulated Olympic race as well as other types of races which players can design for themselves. The board comprises a fixed wind indicator 65 and three marker buoys 24, 25 and 26. Buoys 24 and 25 lie along a line which is parallel to the wind direction. The third buoy is located at a position such that the three buoys approximately form an equilateral triangle.

For the purposes of illustration and explanation of the game board shown in FIG. 5, the direction of the wind will be considered as blowing in a north to south direction. The starting position or starting line is shown by the squares 1–6. Although the starting positions are indicated by numerals 1–6, other appropriate indicia may be used such as letters, colors or shapes which correspond to identical indicia on the game pieces. For example, the squares 1–6 may be labelled with letters which correspond to identical letters on the game pieces. Any number of starting positions and corresponding game pieces may be used, although as a practical matter, about six game pieces is convenient.

The players advance their game pieces from the starting line and proceed in a northerly direction by tacking. In order to accommodate the tacking maneuver, the squares are formed in the first leg by intersecting one set of parallel lines at approximately 45° with respect to the wind direction, with another set of parallel lines which are perpendicular to the first set. As a result the squares in the first leg are oriented so that a sailboat game piece can advance forward (upwind) while observing the permissible sailing directions with respect to the wind, by sailing first in one direction parallel to the first set of lines and then sailing in a second direction parallel to the second set of lines.

Players take turns in advancing their sailboats. The number of squares advanced by a sailboat on any given turn is determined by a chance event which is preferably the roll of a pair of conventional dice.

When a player's game piece reaches the area occupied by buoy 25, he will have to go around the buoy, keeping it on the port side of the boat. The distorted squares located above buoy 25 are used for rounding the buoy and advancing it to the second leg.

The second leg extends from buoy 25 to buoy 26. The squares are oriented in the second leg so that the players can advance their game pieces in a straight line to complete this leg while travelling parallel to one set of straight lines which form the squares.

A third leg is formed between buoys 26 and 24. The squares are similarly oriented so that a player can advance his game piece in a straight line from buoy 26 to buoy 24 while maintaining a course which is parallel to one set of lines which forms the squares in this leg of the race. The third leg is similarly connected to the first and second legs by means of distorted curved squares around buoys 26 and 24, respectively.

An additional leg is formed between buoys 24 and 25. Unlike the other three legs, this fourth leg lies inside the triangle formed by the three buoys. The fourth leg is for sailing with the wind coming directly behind the boat (running before the wind). Consequently, the squares are formed by one set of parallel lines which are parallel to the wind direction, intersecting with another set of parallel lines which are generally perpendicular to the wind direction. The intersections of these lines form squares which are oriented so that a player can advance his sailboat directly down wind in a straight line which is parallel to one set of lines and perpendicular to another set, i.e., parallel to the lines which are parallel to the wind direction.

The fourth leg is connected to the second and third legs. In order to maintain the continuity of squares between these legs, the squares on either end of the fourth leg are distorted to form trapezoids. The trapezoidal squares at either end of the fourth leg are connected to the corresponding squares on the second and third legs so that all the squares of a race course, regardless of their orientation, are contiguous.

The preferred embodiment has a finish line located in one or more positions so that players can select where the race will end. Preferably, a finish line 34 is located at buoy 25 and another finish line 35 is located near buoy 24.

By using the game board of the preferred embodiment shown in FIG. 5, the players can choose various types of races. For example, FIG. 17 illustrates the course the players would follow on an Olympic course and FIG. 16 shows the course players would follow on an American Cup course. In FIGS. 15 and 16, the arrows show the overall direction the sailboats must move to complete the race without showing the detailed tacking required to move the boat in an upwind direction.

The movement of the sailboats is more particularly illustrated with reference to FIG. 6 wherein a portion of the game board of FIG. 5 is shown in greater detail. A zig-zag line 36 is shown to exemplify the direction a boat may go when beating upwind or tacking to advance the sailboat upwind to buoy 25. Of course, the actual squares through which the boat moves depends upon the roll of the dice and the player's decision on when to come about and tack in a different direction. A player comes about by changing direction of his tack as shown, for example, in square 37.

Figure 6:
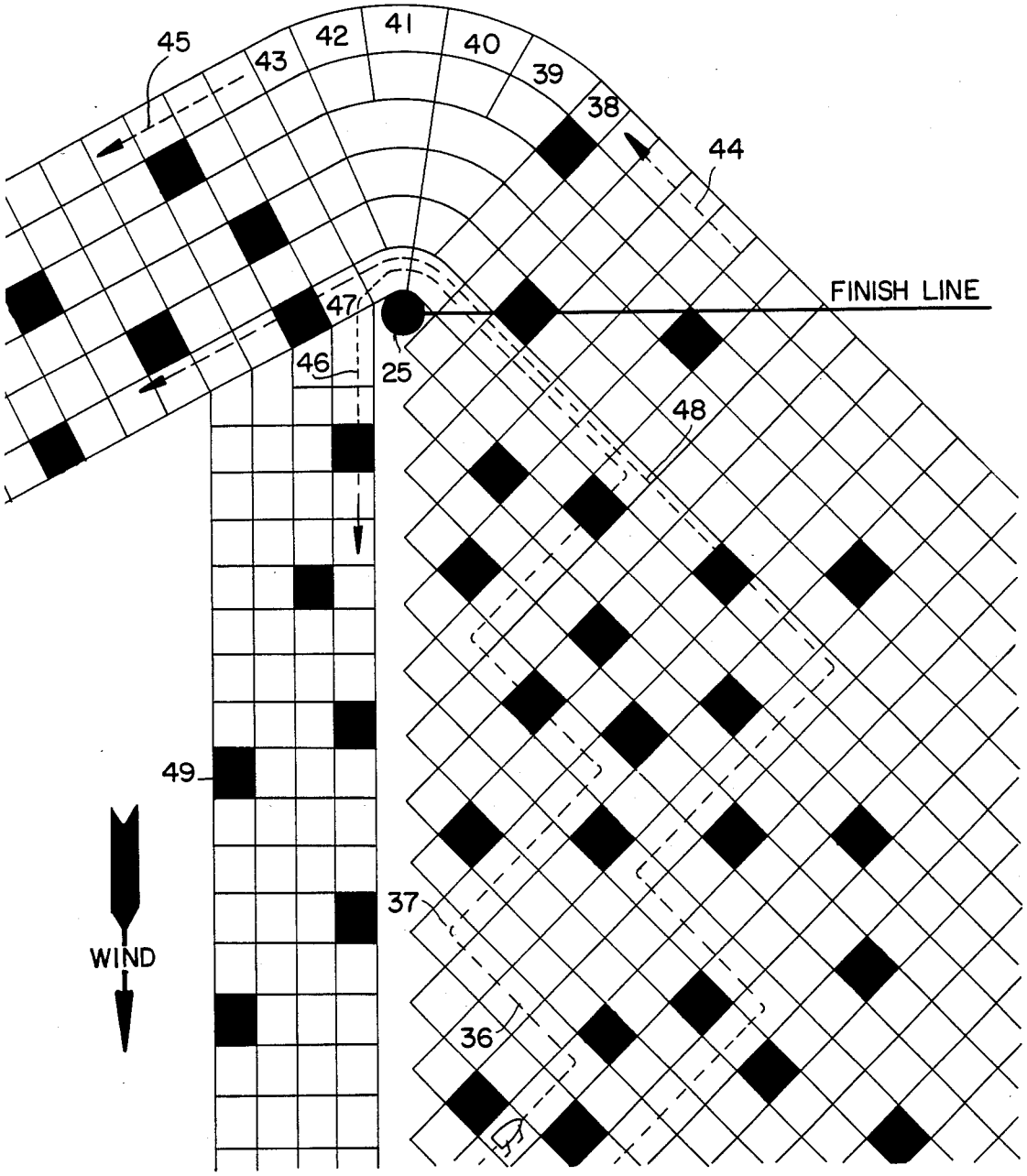
FIG. 6 is an illustration of a portion of the game board shown in FIG. 5.

Distorted squares having curved edges are shown in FIG. 6. Squares 39, 40, 41 and 42 are distorted and serve to connect the square 38 of the outside column of squares in the first leg with a corresponding square 43 of the outside column of squares in the second leg. The outside column of squares in the first leg lie along the line indicated by arrow 44 and the squares of the outside column of the second leg lie along the line indicated by arrow 45. Five other columns are similarly connected by the distorted squares above buoy 25.

Trapezoidal square 46 of the fourth leg is shown connected to square 47 of the second leg. The remaining trapezoidal squares of the fourth leg near buoy 25 are similarly connected to the corresponding squares of the second leg. Thus, a player moving along line 36 can continue around buoy 25 and proceed to the fourth leg as shown by the continuation of line 36 around buoy 25 and downwind into the fourth leg. Likewise, a player proceeding along line 48 can proceed from the first leg around buoy 25 to the second leg.

A preferred embodiment of the game includes the placement of markings on some of the squares which indicate that a player must pick up a game card when landing on a marked square. The squares are preferably marked by being darkened but any sort of indicia may be used such as stars, letters, questions marks, designs or representations of familiar objects such as anchors, boats, etc.

In the preferred embodiment shown in FIG. 5, these marked squares are indicated by being darkened. Square 49 in FIG. 6 shows a typical darkened square.

When a player lands on any of the marked squares, he must pick up a playing card. The playing cards have a message on one side (the face side). The cards are placed face down, preferably on the area marked "place cards here" shown in FIG. 5. When a player picks up a card, he must comply with the message printed on the face side of the card. There are preferably eight types of cards, each of which has a different message. The preferred messages are: equipment failure, move back two spaces; wind shift, move ahead three spaces; wind shift, move back three spaces; man overboard, move back two spaces and over one; correct sail trim, move ahead two spaces; bad sail trim, move back three spaces; good tack, move ahead two spaces; and, bad tack, move sideways two spaces. These cards are illustrated in FIGS. 7–14.

The game is played in accordance with a set of rules. The rules and method of play are illustrated with respect to FIGS. 5 and 6.

The game begins by each player placing his game piece on the corresponding starting position shown in FIG. 5. The starting positions are numbered 1–6. The players take turns rolling a pair of dice and advance their game piece the number of squares shown by the dice. The player in position 1 goes first and the order of play is from 1–6. When on the first leg of the race, the players must move diagonally with respect to the wind and must move a minimum of four squares per roll before tacking unless the player reaches an edge in which case he can tack earlier. The players can move more than four spaces in one direction if they choose. Lines 36 and 48 in FIG. 5 illustrate boats tacking in directions which are diagonal with respect to the wind direction. It will be observed, however, that although they are tacking diagonally with respect to the wind, they are not moving in a diagonal direction with respect to the squares.

A player may not run into another boat. If a player's boat is going to run into another boat, he must either tack and go around him or fall off and go around him as shown in FIGS. 17 and 18. This is because two boats are not permitted to occupy the same space at the same time nor are they permitted to jump over each other. In FIG. 17, boat 50 is moving in a direction which places it on a collision course with boat 51. In such a situation, boat 50 must either fall off as shown by the arrows in squares 52 and 53, or must tack to go around boat 51 as shown by the arrows in squares 54, 55 and 56. Likewise, in FIG. 18, boat 50 must move in accordance with the directions indicated by the arrows in squares 57, 58, 59, 60, 61 and 62.

When a boat in play passes a stationary boat to windward or lands on a space to windward of a stationary boat, then the stationary boat must move back two spaces.

When a player lands on a darkened space he must pick up the top card on the pile and do as it says.

The object of the game is to be the first player around the complete race course. The players may have just one race if they like, or they can have a series of races and give points to the position in which they finish. The player with the lowest points wins the race. The points may be allocated as follows:

first place: ¾ point;
second place: 2 points;
third place: 3 points;
fourth place: 4 points;
fifth place: 5 points;
sixth place: 6 points.

To finish and win the race, a player must be first in either landing on or going over the finish line.

I claim:

1. A sailboat racing gameboard for a game played with sailboat game pieces which comprises a surface area marked off into a gridwork of squares; fixed indicia for indicating a fixed wind direction; a plurality of indicia on the surface for representing marker buoys, said marker buoy indicia being arranged in a configuration to form a race course having a plurality of connected legs in the area marked off into squares wherein the squares of each leg are contiguous; said legs being selected from the group consisting of broad reach legs, beam reach legs, upwind legs, downwind legs and combinations thereof; said course including at least one upwind leg and a downwind leg; said squares of the upwind and downwind legs being oriented in different directions; said squares of the upwind leg being formed by the intersection of two sets of generally parallel lines, each set of which is oriented in a direction which is diagonal with respect to the fixed wind direction so that sailboat game pieces can be tacked in an upwind direction which is diagonal with respect to the fixed wind direction but not diagonal with respect to the orientation of the squares; said squares of the downwind leg being formed by the intersection of one set of generally parallel lines which are generally parallel to the fixed wind direction and another set of generally parallel lines which is generally perpendicular to the fixed wind direction; and said squares of all other legs being formed by the intersection of one set of generally parallel lines which is generally parallel to the leg and another set of generally parallel lines which is generally perpendicular to the leg; and said surface area further comprising a set of distorted squares for connecting together the squares of different legs in which the squares are not oriented in the same direction with respect to the fixed wind so that all the squares on the board are contiguous.

2. A sailboat racing board game, for use with playing pieces which simulate sailboats, said game comprising a game board and playing pieces movable over the game board; said game board comprising a surface area marked off into a gridwork of squares; fixed indicia for indicating a fixed wind direction; a plurality of indicia on the surface for representing marker buoys, said marker buoy indicia being arranged in a configuration to form a racecourse having a plurality of connected legs in the area marked off into squares wherein the squares of each leg are contiguous; said legs being selected from the group consisting of broad reach legs, beam reach legs, upwind legs, downwind legs, and combinations thereof; said course including at least an upwind leg and a downwind leg; said squares of the upwind and downwind legs being oriented in different directions; said squares of the upwind leg being formed by the intersection of two sets of generally parallel lines, each set of which is oriented in a direction which is diagonal with respect to the fixed wind direction so that sailboat game pieces can be tacked in an upwind direction which is diagonal with respect to the fixed wind direction but not diagonal with respect to the orientation of the squares; said squares of the downwind leg being formed by the intersection one one set of generally parallel lines which is generally parallel to the fixed wind direction and another set of generally parallel lines which is generally perpendicular to the fixed wind direction; and said squares of all other legs being formed by the intersection of one set of generally parallel lines which is generally parallel to the leg and another set of generally parallel lines which is generally perpendicular to the leg; and said surface area further comprising a set of distorted squares for connecting together the squares of different legs in which the squares are not oriented in the same direction with respect to the fixed wind so that all the squares on the board are contiguous.

3. The game of claim 2 which further comprises a set of cards, each of which indicates a direction and number of squares a gamepiece is to be moved; and a plurality of squares on the gameboard having indicia thereon for instructing a player to pick up a game card.

4. The game of claim 3 wherein the marker buoys form a triangle having one upwind leg, two broad reach legs and one downwind leg.

5. The game of claim 4 wherein the triangle is equilateral and the squares of each leg are oriented in a different direction.

6. The game of claim 5 wherein the gamepieces are in the shape of a sailboat having a bow and a stern.

7. A sailboat racing board game for use with simulated sailboat playing pieces which comprises a game board, playing pieces movable over the game board, and game cards; said game board comprising a surface area marked off into a gridwork of squares; fixed indicia on the surface for indicating a fixed wind direction; three indicia on the surface for representing first, second and third marker buoys, said buoys being arranged in a triangular configuration to form a triangular race course in the area marked off into squares; said race course having an upwind leg between the first and second buoys; a broad starboard reach leg between the second and third buoys; a broad port reach leg between the third and first buoys; and a downwind leg between the second and first buoys; said broad reach legs and upwind legs being located on the outside of the triangle formed by the buoys and said downwind leg being located inside the triangle parallel to and adjacent to the upwind leg; said squares of all the legs being oriented in different directions; said squares along the upwind leg being formed by the intersection of two sets of generally parallel lines, each set of which is oriented in a direction which is diagonal with respect to the fixed wind direction so that sailboat game pieces can be tacked in an upwind direction which is diagonal with respect to the fixed wind direction but not diagonal with respect to the orientation of the squares; said squares of the downwind leg being forward by the intersection of one set of generally parallel lines which are generally parallel to the fixed wind direction and another set of generally parallel lines which is generally perpendicular to the fixed wind direction; and said squares of the broad starboard reach leg being formed by the intersection of one set of generally parallel lines which is generally parallel to the leg and another set of generally parallel lines which is generally perpendicular to the leg; and said squares of the broad port reach leg being formed by the intersection of one set of generally parallel lines which is generally parallel to the leg and another set of generally parallel lines which is generally perpendicular to the leg; and said upwind and broad reach legs being connected to each other around each buoy by means of distorted squares having curved sides-,and said downwind leg being connected to the broad reach legs by means of trapezoidal shaped distroted squares; and said fixed wind direction indicia being a fixed arrow pointing in a direction parallel to the upwind and downwind legs to indicate wind passing from the second buoy to the first buoy and said game cards having indicia on one side which indicates a direction and number of squares a game piece is to be moved; and a plurality of squares having game card indicia thereon for instructing a player to pick up a game card.

8. A sailboat racing board game of claim 7 wherein one set of generally parallel lines of the upwind leg is generally perpendicular to the other set of generally parallel lines of the upwind leg and each set is oriented at about a 45° angle with respect to the fixed wind direction.

9. A sailboat racing board game of claim 8 wherein the game pieces are in the shape of sailboat having a bow and a stern.

10. The game of claim 9 wherein the squares having the game card indicia thereon are distributed on each leg so that it is possible for a player to avoid landing on those squares having the game card indicia.

11. The game of claim 10 wherein the squares having the game card indicia thereon comprise a darkening of the square.

12. The game of claim 11 which further comprises a starting line at the downwind end of the upwind leg and a pair of finish lines, one being at the downwind end of the downwind leg and another being at the upwind end of the upwind leg.

13. The game of claim 12 wherein the game cards have indicia thereon selected from the group consisting of the following: equipment failure, move back 2 spaces; wind shift, move ahead 3 spaces; wind shift, move back 3 spaces; man overboard, move back 2 spaces and over 1; correct sail trim, move ahead 2 spaces; bad sail trim, move back 3 spaces; good tack, move ahead 2 spaces; and, bad tack, move sideways 2 spaces.

14. The game of claim 13 which further comprises an area on the board marked for placing the game cards thereon.

15. A sailboat racing game board for a game played with sailboat game pieces which comprises a surface are marked off into a gridwork of squares; fixed indicia for indicating a fixed wind direction; a plurality of indicia on the surface for representing marker buoys, said marker buoy indicia being arranged in a configuration to form a race course having a plurality of connected legs in the area marked off into squares wherein the squares of each leg are contiguous; said legs being selected from the group consisting of broad reach legs, beam reach legs, upwind legs, downwind legs and combinations thereof; said course including at least an upwind leg wherein the squares of the upwind leg are oriented in a different direction from the squares of at least one other leg; said squares of the upwind leg being formed by the intersection of two sets of generally parallel lines, each set of which is oriented in a direction which is diagonal with respect to the fixed wind direction so that the sailboat game pieces can be tacked in the upwind leg in an upwind direction which is diagonal with respect to the wind but not diagonal with respect to the orientation of the squares, and said squares of all other legs being formed by the intersection of one set of generally parallel lines which is parallel to the leg and another set which is generally perpendicular to the leg; and said surface area further comprising a set of distorted squares for connecting together the squares of different legs in which the squares are not oriented in the same direction with respect to the fixed wind direction so that all the squares on the board are contiguous.

* * * * *